United States Patent [19]

Nassar

[11] Patent Number: 4,825,483

[45] Date of Patent: May 2, 1989

[54] SOFA WHICH CAN BE CONVERTED TO A BED

[76] Inventor: Jihad Nassar,
Saint-Nazaire-les-Eymes, 38330
Saint-Ismier, France

[21] Appl. No.: 171,647

[22] Filed: Mar. 22, 1988

[30] Foreign Application Priority Data

Mar. 26, 1987 [FR] France ..... 87 04436

[51] Int. Cl.[4] ..... A47C 17/00; A47C 17/13

[52] U.S. Cl. ..... 5/12 R; 5/12 B; 5/17; 297/457

[58] Field of Search ..... 5/12 R, 12 B, 15, 17, 5/18 R, 417, 420; 297/457

[56] References Cited

U.S. PATENT DOCUMENTS 1,321,911 11/1919 Hawkins ..... 5/12 B

FOREIGN PATENT DOCUMENTS 494630 3/1930 Fed. Rep. of Germany .
687363 4/1930 France ..... 5/15
2491313 10/1980 France .

*Primary Examiner*—Alexander Grosz
*Attorney, Agent, or Firm*—Parkhurst, Oliff & Berridge

[57] ABSTRACT

Sofa which can be converted to a bed comprising a base having two opposite sides (1), between which there extends an upper longitudinal rod (4) and a canvas sheete (10) or equivalent which passes over this rod and is transversely movable with respect to the latter between two end positions, the opposite longitudinal edges (11, 12) of this sheet, in a first position, being held so as to form a seat in front of the said upper longitudinal rod, and it being possible for said sheet to be displaced by passing over and under the said rod to be brought into a second, extended position, to form a bed in front of the said upper longitudinal rod, and vice versa.

10 Claims, 4 Drawing Sheets

SOFA WHICH CAN BE CONVERTED TO A BED

The present invention relates to the field of furniture and more particularly to a sofa which can be converted to a bed and which can also, on a reduced scale, constitute a toy.

Of the various couches which can be converted to beds which are currently known, a first type comprises two parts of which one is the horizontal part which forms the seat in the sofa position and the other is the vertical part which forms the back in the sofa position. A second type comprises three parts, the first part consisting of the back, the second of the seat and the third being folded on the seat or behind the back. According to a third type of sofa which can be converted to a bed, a three-part structure is folded in the seat of a sofa which is a type of chest containing these folded elements.

All these sofas which can be converted to beds from the prior art have a relatively complex rigid mechanical structure which is liable to jam or to injure the people handling them. On the other hand, in most of these systems, the seat supports are the same as the bed supports, and so the seat must be completely flat, since the bed has to be. This gives a rather uncomfortable sitting position. Moreover, in practice, it is found that all these sofa beds are relatively heavy.

On the other hand, it is frequently the case that a sofa bed is an item of furniture which is chiefly used as a sofa and only exceptionally as a bed.

One subject of the present invention is the providing of a sofa which can be converted to a bed which has a particularly light structure, is simple to handle and is comfortable in particular in the sofa position.

The sofa which can be converted to a bed, according to the present invention, comprises a base having two opposite sides, between which there extends an upper longitudinal rod and a canvas sheet or equivalent which passes over this rod and is transversely movable with respect to the latter between two end positions, the opposite longitudinal edges of this sheet, in a first position, being held so as to form a seat in front of the said upper-longitudinal rod, and it being possible for the said sheet to be displaced by passing over and under the said rod to be brought into a second, extended position, to form a bed in front of the said upper longitudinal rod, and vice versa.

According to the present invention, the opposite longitudinal edges of the said sheet preferably each carry a longitudinal rod, means being provided to hold the ends of these rods when the said sheet is in its first position.

In accordance with the present invention, and in order to facilitate the movement of the said sheet, means are preferably provided to guide the ends of the longitudinal rod connected to the front longitudinal edge of the said sheet when this sheet passes from its first position to its second position, and vice versa.

In one variant embodiment, the sofa which can be converted to a bed, according to the present invention, comprises a fixed frame forming the said base and comprising, towards the rear and the top, the said upper longitudinal rod, a frame which is movable between two end positions and is pivotably mounted on the opposite sides of the fixed frame, parallel to the said upper longitudinal rod, the front edge of the said sheet being fixed to the movable frame, parallel to the said upper longitudinal rod, in a manner which distances it from the jointing means of this movable frame on the fixed frame, it being possible for the rear edge of the said sheet to be locked against one of the said frames when this sheet is in its first position. In particular, the front edge of the said sheet is located in front of these jointing means when this sheet is in its first position and is behind these jointing means when the said sheet is in its second position.

In this variant it can be advantageous for the movable frame to have a means of locking the longitudinal rod connected to the rear longitudinal edge of the said sheet, this means being shaped so that it can bring with it the said rod when this frame pivots from its first position to its second position, and enabling the rod to be withdrawn in particular when the frame is in an intermediate position.

In another variant of the sofa which can be converted to a bed, according to the present invention, the opposite sides of the said base each comprise a ramp or a groove in which the ends of the longitudinal rod connected to the front longitudinal edge of the said sheet can slide when the said sheet passes from its first position to its second position, and vice versa.

According to the present invention, the said grooves or ramps can advantageously pass over the said upper longitudinal rod and extend towards the front so as to be inclined towards the ground, and behind this rod, towards the bottom, the ends of these grooves or ramps preferably constitute end stops for the said front longitudinal rod.

The base of the sofa which can be converted to a bed, according to the present invention, can furthermore comprise a lower longitudinal rod located below the said upper longitudinal rod, the said sheet passing under and behind this lower longitudinal rod.

In one variant, the said sheet can advantageously be made in the form of a mattress having hollow or thinner longitudinal parts, enabling it to be deformed when it is moved around the said upper longitudinal rod and, where appropriate, around the said lower longitudinal rod, and when it forms a seat in front of the said upper longitudinal rod.

The characteristic features and advantages of the present invention will be explained in more detail in the description below of particular embodiments, shown in the drawing, in which.

Figure 1:
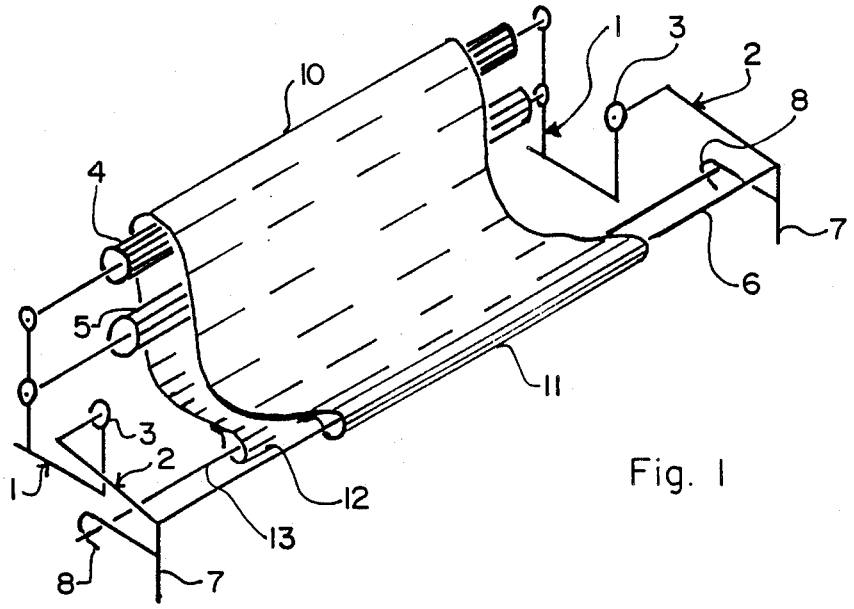
FIG. 1 shows a simplified perspective view of a first sofa which can be converted to a bed, according to the present invention, in the sofa position.

The first sofa shown which can be converted to a bed will be described with reference to FIGS. 1 to 7. This sofa comprises a fixed frame or stand 1 resting on the ground and a movable frame or stand 2, which is jointed, on the fixed frame. The fixed frame comprises means for supporting side joints 3, on which is jointed longitudinally the movable frame 2, an upper longitudinal rod 4 arranged towards the rear of this stand and possibly a lower longitudinal rod 5 arranged towards the rear of this stand below the rod 4. In practice, this frame may be composed of two lateral sides, visible in FIG. 3, serving as supports to the rods 4 and 5 and joining them to each other; there are arranged in these sides the joints 3, for example openings opposite which there are placed openings of the movable frame and shafts which hold together in jointed manner the movable frame and the fixed frame. In the fixed stand 1, there may also be provided other bars for connecting the abovementioned two lateral sides. These lateral sides can be of any shape adapted to fulfil the particular requirements of style and decoration.

The movable frame 2 essentially carries a longitudinal rod 6 parallel to the rods 4 and 5 and to the line between the joints 3. The movable frame also comprises means, such as feet 7, to hold the rod 6 at a certain height above the ground in the sofa position. Finally, locking means 8, the purpose of which will be explained below, can also be provided on the movable frame 2. As in the preceding case, this frame can essentially comprise lateral sides of the style desired, connected by the rod 6 and possibly other rods, these lateral sides being outside the lateral sides of the fixed frame 1.

A sheet 10 is fastened by means of its front edge 11 to the rod 6 or rests on this rod and is fastened to another rod or another element of the movable frame 2. This sheet is made to pass over and behind the rod 4 and behind and under the rod 5, and its rear edge, which is normally free, is locked in the sofa position at one of the two frames. In the embodiment shown, a longitudinal rod 13 is fastened to the rear edge 12 of the sheet 10, and this rod 13 lodges in the locking means in catches 8 of the movable frame 2.

Figure 2:
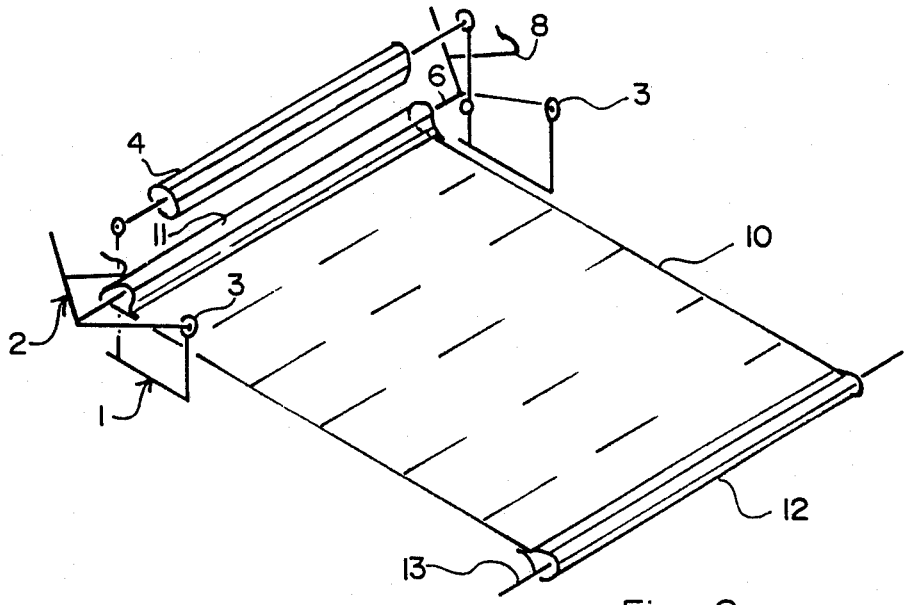
FIG. 2 shows a partial, simplified perspective view of a sofa bed of FIG. 1 in the bed position.

FIG. 2 shows the sofa which can be converted to a bed of FIG. 1 in the bed position, the lower rod 5 having been omitted to facilitate understanding of this figure. In the bed position, the movable frame 2 is made to pivot about the longitudinal joint 3 such that the rod 6 carrying the front edge of the sheet 10 is brought with it by pivoting over and behind the upper rod 4 until it rests practically on the ground. During this, the rear edge of the sheet 10 is drawn forwards, and the sheet 10 as a whole rests on the ground to form a support on which to lie.

The functioning and use of the abovementioned sofa which can be converted to a bed will now be described.

Figure 3:
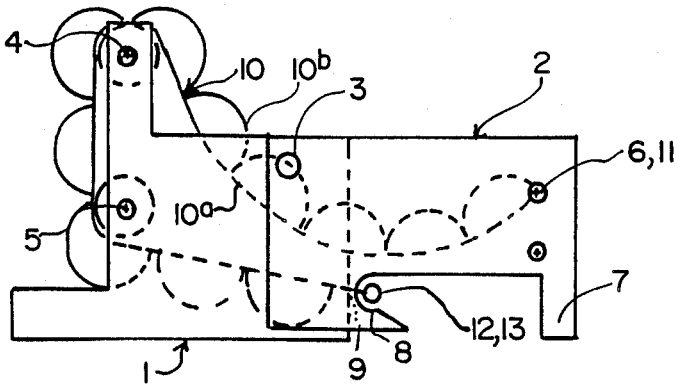
FIGS. 3 to 7 show highly diagrammatic side views of a sofa which can be converted to a bed of FIG. 1, FIG. 3 corresponding to the sofa position, FIG. 6 to the bed position and FIGS. 4, 5 and 7 to the intermediate positions.

FIG. 3 shows a side view in a sofa position which is identical to that of FIG. 1, in both of which the movable stand 2 bears against the ground at the front.

Figure 4:
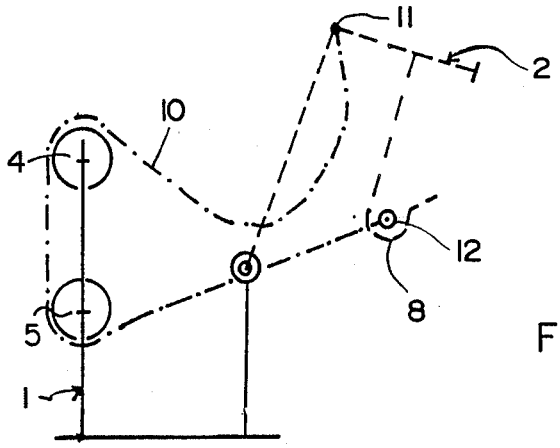
Figure 5:
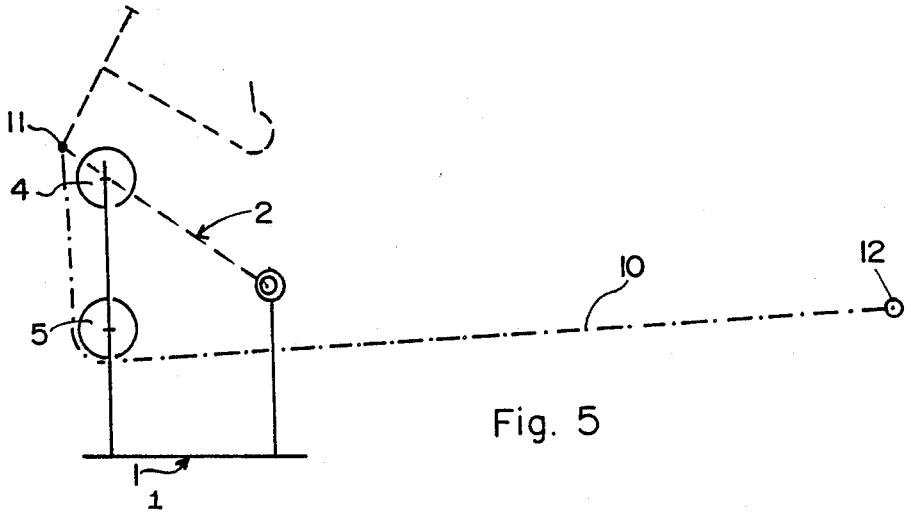

To pass into the bed position, the user takes the rod 6 or another part of the movable frame 2 and raises it until it is substantially in the position of FIG. 4. He can then take hold of the rear edge 12 of the sheet 10 and draw it forwards, while the jointed frame continues to pivot backwards, as shown in FIG. 5. Then, in the position of FIG. 6, or in an adjacent position, depending on the shape of the fixed frame 1, the movable frame 2 and the locking elements provided between them, the movable frame 2 becomes locked while the sheet 10 rests on the ground.

Figure 6:
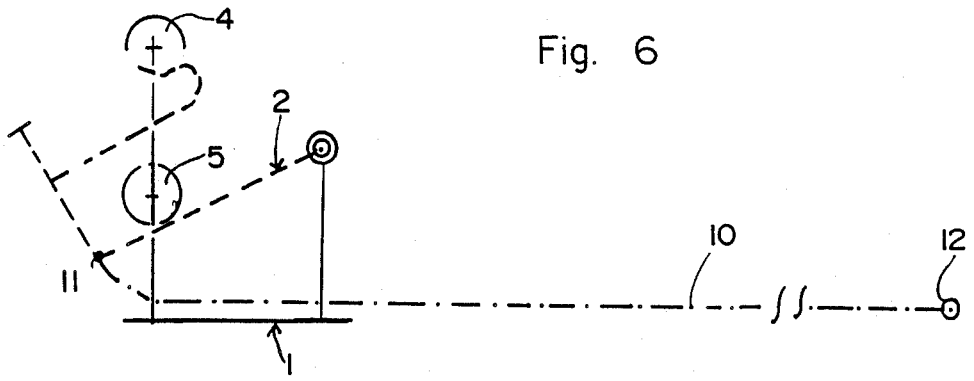
Figure 7:
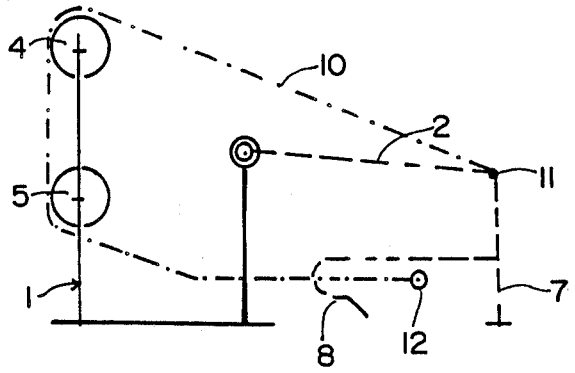

FIG. 7 shows an intermediate position of the sofa which can be converted to a bed, where it has been attempted to pass from the position of FIG. 6 to that of FIG. 3, by tipping the movable frame 2 in the opposite direction. At the point where the movable frame 2 has been brought towards its sofa position, with its feet 7 on the ground, the sheet is not engaged in the locking element 8. However, the simple fact of sitting down or leaning on the sheet brings it into the locked position as a result of the appropriate shaping of the locking means 8, as is shown.

The sofa which can be converted to a bed described above is capable of a number of variants. Free rolls can be mounted on the rods 4, 5, 6 and 13 to facilitate the movements of the sheet. An additional rod can be fastened to the sheet at the point corresponding to the bottom of the seat in the sofa position, locking means being provided in one of the two frames to lock the sheet into the sofa position and stiffen the seat. The dimensions of the sheet and the various elements supporting it can be selected in order that, in the bed position, the dimension of the sheet forming the mattress placed on the ground makes possible a double or single bed, parallel or perpendicular to the sofa. These dimensions can equally well be suited to adults, children or for toys. An additional flat base composed of thin slats can be provided, comprising a row of slats fastened to the rear of the fixed frame 1, going as far as the front of the movable frame 2 and having openings in which another row of slats slides, these slats also having openings in which a third row of slats connected to the rod 13 of the rear of the mattress slides. In the bed position, these slats spread out, following the path of the rod 13. When the bed is returned to the sofa position, the slats slide backwards, and the rod 13 takes up the third and then the second row of slats. Thus, all the slats are arranged below the sofa. It would also be possible to provide for the thin-slatted base to the rolled around a roller means. The part which is the surface on which to lie consists of a thin mattress covered with a bedsheet and another bedsheet and a cover which covers the whole and is connected front and rear by slide openings or other openings. The edges of the cover can be held below the mattress or be joined by slide openings or other openings, in order to hold in place the bedsheets and the mattress during the movements for converting from sofa to bed and vice versa. Springs can connect the movable frame to the fixed frame, to assist in the lifting of the mattress during the conversion from sofa to bed and vice versa.

The sofa which can be converted to a bed shown in FIGS. 8 to 10 will now be described. This sofa which can be converted to a bed comprises a framework 15 resting on the ground and comprising two opposite and parallel sides **15*a*, 15*b*, which are connected to one another by an upper longitudinal rod 17, a lower longitudinal rod 18 and a reinforcing longitudinal rod 27. Two free rolls 25 and 26 respectively surround the rods 17 and 18. In this fixed framework there are made slots, grooves or openings 16 which are to serve to guide the sheet 21. The grooves 16 extend over the rod 17 and are lengthened towards the front while being inclined downwards and are lengthened vertically and downwards behind the rod 17**.

The front edge 22 of the sheet 21 surrounds a longitudinal rod 19. This rod rests at seat height on the front end of the groove 16 and serves as a limit stop 28 for it.

The sheet 21 is wound about the free roll 25 and then the free roll 26. Its rear edge 23 is fastened to a rear longitudinal rod 24, the ends of which extend in front of the sides 15*a* and 15*b* of the framework 15. When someone sits on the sofa, between the front rod 19 and the upper rod 17, the front rod 19 abuts against the front ends 28 of the grooves 16, and the rear rod 24 abuts against the stop 20 provided on the framework 15, close to the ground, and oriented towards the front, and retains the sheet 15 in the sofa position.

Figure 9:
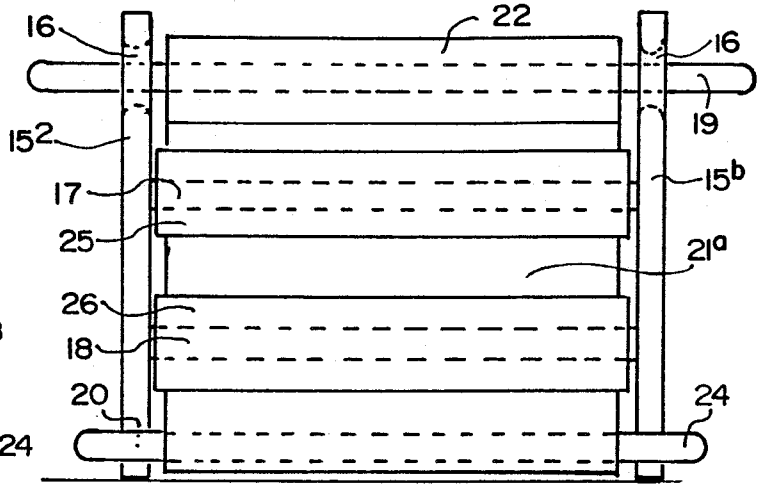
FIG. 9, shows a front view of the sofa which can be converted to a bed from FIG. 8, in an intermediate position.

In FIG. 9, the rod 19 of the front edge 22 of the sheet 21 is shown in its highest position above the upper horizontal rod 17 and the free roll 25 which surrounds it. This first edge is in the groove 16 in each of the sides 15*a* and 15*b* of the framework 15. This groove is sufficiently wider than the diameter of the rod 19. The rod 19 emerges on both sides of the sides 15*a* and 15*b*.

Figure 8:
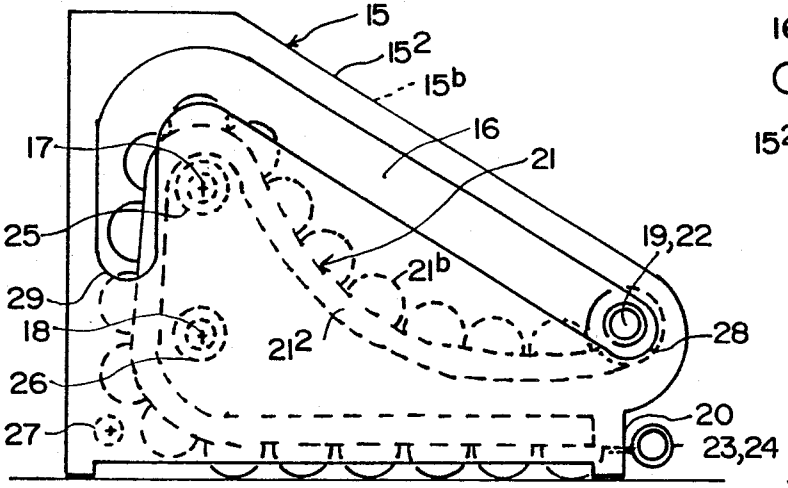
FIG. 8 shows a side view of a second sofa which can be converted to a bed, according to the present invention, in the sofa position.
Figure 10:
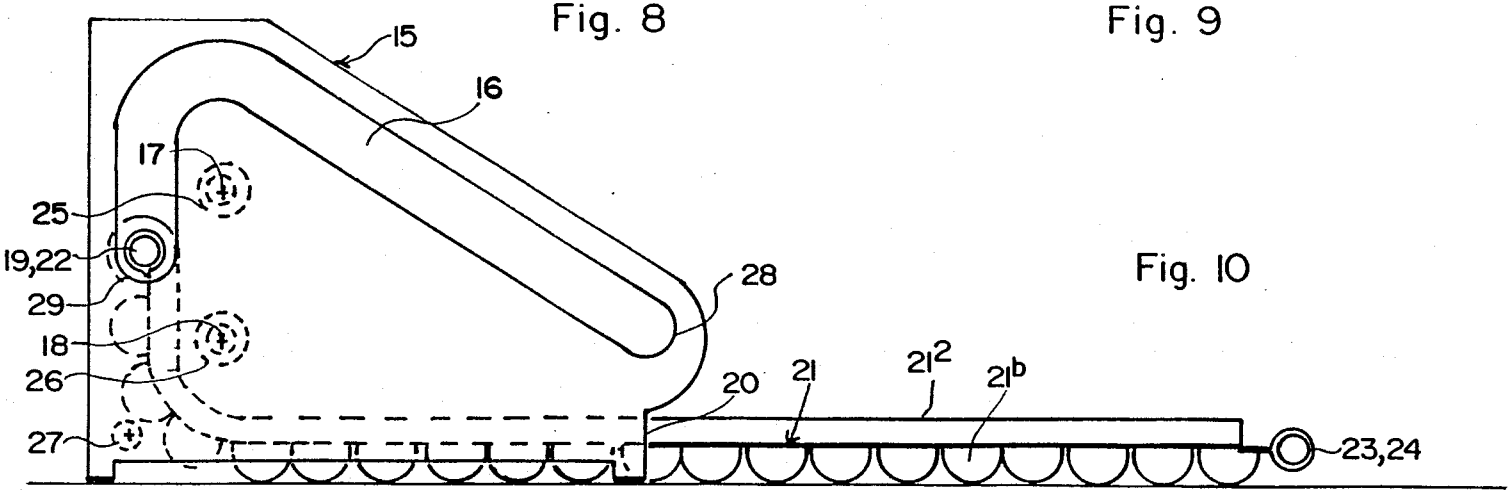
FIG. 10 shows a side view of the sofa which can be converted to a bed of FIG. 8, in the bed position.

To convert the sofa of FIG. 8 into the bed of FIG. 10, the user takes the second edge 23 of the sheet 21 and draws it forwards. The sheet becomes taut and brings with it towards the rear the first rod 19 in the slides or grooves 16. At its final point, the sheet 21 is spread out on the ground.

FIG. 10 shows the sheet 21 spread out on the ground with the face on which to lie 21*a* facing upwards. The front rod 19 of the sheet 21 rests gainst the end 29 in the vertical part of the groove 16.

To bring the sheet 21 back into the sofa position, two people, one on each side, take the ends of the rod 19 of the sheet 21 and bring it back into the grooves 16, as far as their front ends which form the stops 28.

The sheet is in a position similar to that shown in FIG. 7. All that is necessary is to push it or to sit down on the sheet, between the front rod 19 and the upper rod 17, for the second rod 24 of the sheet 21 to abut against the stop 20 of the framework and hold the seat face 21*b* in the sofa position.

It will be seen from FIG. 8 that the sheet 21 is made in the shape of a mattress which comprises projecting longitudinal parts such that the mattress can be deformed when it is wound around the longitudinal rods 17 and 18 and when it is curved to form the seat in front of the longitudinal rod 17.

The second embodiment described above is capable of a number of variants. In particular, the adaptation of a mechanism driving the first rod 22, composed of chains and sprocket wheels and wound around the groove 16, is quite possible. The grooves 16 and the rod 19 could be replaced by a ramp with sliding rings on it. The dimensions of the sheet can be adapted to adults or children or even for toys. An additional flat base could be provided and arranged in an accordion shape below the mattress.

The present invention is of course not limited to the examples described above. A number of other variant embodiments are possible without departing from the scope defined by the attached claims.

I claim:

1. Sofa which can be converted to a bed, characterized in that it comprises a base having two opposite sides (1; 15*a*, 15*b*), between which there extends an upper longitudinal rod (4; 17) and a sheet (10; 21) which passes over this rod and is transversely movable with respect to the latter between two end positions, the opposite longitudinal edges (11, 12; 22, 24) of this sheet, in a first position, being held so as to form a seat in front of the said upper longitudinal rod, and it being possible for the said sheet to be displaced by passing over and under the said rod to be brought into a second, extended position, to form a bed in front of the said upper longitudinal rod, and vice versa.

2. Sofa which can be converted to a bed, according to claim 1, characterized in that the opposite longitudinal edges (11, 12; 22, 24) of the said sheet (10; 21) each carry a longitudinal rod, means being provided to hold the ends of these rods when the said sheet is in its first position.

3. Sofa which can be converted to a bed, according to claim 2, characterized in that means (2; 16) are provided to guide the ends of the longitudinal rod connected to the front longitudinal edge of the said sheet when this sheet passes from its first position to its second position, and vice versa.

4. Sofa which can be converted to a bed, according to claim 2, characterized in that the opposite sides of the said base each comprise a ramp or a groove (16) in which the ends of the longitudinal rod connected to the front longitudinal edge of the said sheet can slide when the said sheet passes from its first position to its second position, and vice versa.

5. Sofa which can be converted to a bed, according to claim 4, characterized in that the said groove or ramps (16) pass over the said upper longitudinal rod and extend towards the front so as to be inclined towards the ground, and behind this rod, towards the bottom, the ends of these grooves or ramps constitute end stops for the said front longitudinal rod.

6. Sofa which can be converted to a bed, according to claim 1, characterized in that it comprises a fixed frame (1) forming the said base and comprising, towards the rear and the top, the said upper longitudinal rod (4), a frame (2) which is movable between two end positions and is pivotably mounted on the opposite sides of the fixed frame, parallel to the said upper longitudinal rod, the front edge (11) of the said sheet being fixed to the movable frame, parallel to the said upper longitudinal rod, in a manner which distances it from the jointing means of this movable frame on the fixed frame, it being possible for the edge of the said sheet to be locked against one of the said frames when this sheet is in its first position.

7. Sofa which can be converted to a bed, according to claim 6, characterized in that the front edge of the said sheet is located in front of these jointing means when this sheet is in its first position and is behind these jointing means when the said sheet is in its second position.

8. Sofa which can be converted to a bed, according to claim 6, characterized in that the movable frame (2) has a means (8) of locking the longitudinal rod connected to the rear longitudinal edge of the said sheet, this means being shaped so that it can bring with it the said rod when this frame pivots from its first position to its second position, and enabling the rod to be withdrawn in particular when the frame is in an intermediate position.

9. Sofa which can be converted to a bed, according to claim 1, characterized in that the base furthermore comprises a lower longitudinal rod (5; 18) located below the said upper longitudinal rod, the said sheet passing, under and behind this lower longitudinal rod.

10. Sofa which can be converted to a bed, according to claim 1, characterized in that the said sheet (21) is made in the form of a mattress having hollow or thinner longitudinal parts enabling it to be deformed when it is moved around the said upper longitudinal rod and, where appropriate, around the said lower longitudinal rod, and when it forms a seat in front of the said upper longitudinal rod.

* * * * *